United States Patent [19]

Johansson

[11] Patent Number: 4,700,416

[45] Date of Patent: Oct. 20, 1987

[54] PATIENT TRANSFER MAT

[76] Inventor: Paul J. Johansson, 1416 Grant Rd., Northbrook, Ill. 60062

[21] Appl. No.: 869,367

[22] Filed: Jun. 2, 1986

Related U.S. Application Data

[63] Continuation-in-part of Ser. No. 830,261, Feb. 18, 1986.

[51] Int. Cl.[4] ..... A61G 7/08

[52] U.S. Cl. ..... 5/81 R; 5/81 B; 5/82 R; 5/89

[58] Field of Search ..... 5/81 R, 81 B, 82 R, 5/82 B, 89; 16/225, 385, DIG. 13; 108/67, 68; 128/88; 160/229 R, 231 R

[56] References Cited

U.S. PATENT DOCUMENTS

| | | | |
|---|---|---|---|
| 2,210,652 | 8/1940 | Dernett | 16/225 |
| 2,690,799 | 10/1954 | Gerstenmaier | 16/225 |
| 2,978,020 | 4/1961 | Paulsrudl | 160/229 R |
| 3,151,343 | 10/1969 | McCormick | 5/82 R |
| 3,849,813 | 11/1974 | Neilson | 5/81 R |
| 4,033,007 | 7/1977 | Bonifay | 5/82 R |
| 4,209,011 | 6/1980 | Peck et al. | 128/87 R |

*Primary Examiner*—Gary L. Smith
*Assistant Examiner*—Michael F. Trettel
*Attorney, Agent, or Firm*—Silverman, Cass, Singer & Winburn, Ltd.

[57] ABSTRACT

An improved patient transfer mat for aiding the moving of a patient who cannot move oneself. The mat includes a center section and a pair of wing sections hingedly attached thereto and adapted to be placed under the patient. The sections are hingedly attached by flexible web material hinges molded into the edges thereof and extending between the sections. The mat including grasping openings in each end with slots adjacent thereto for securing a strap therethrough to secure the patient to the mat. A pair of mats are placed under the patient forming a system to move the patient by sliding or lifting.

15 Claims, 8 Drawing Figures

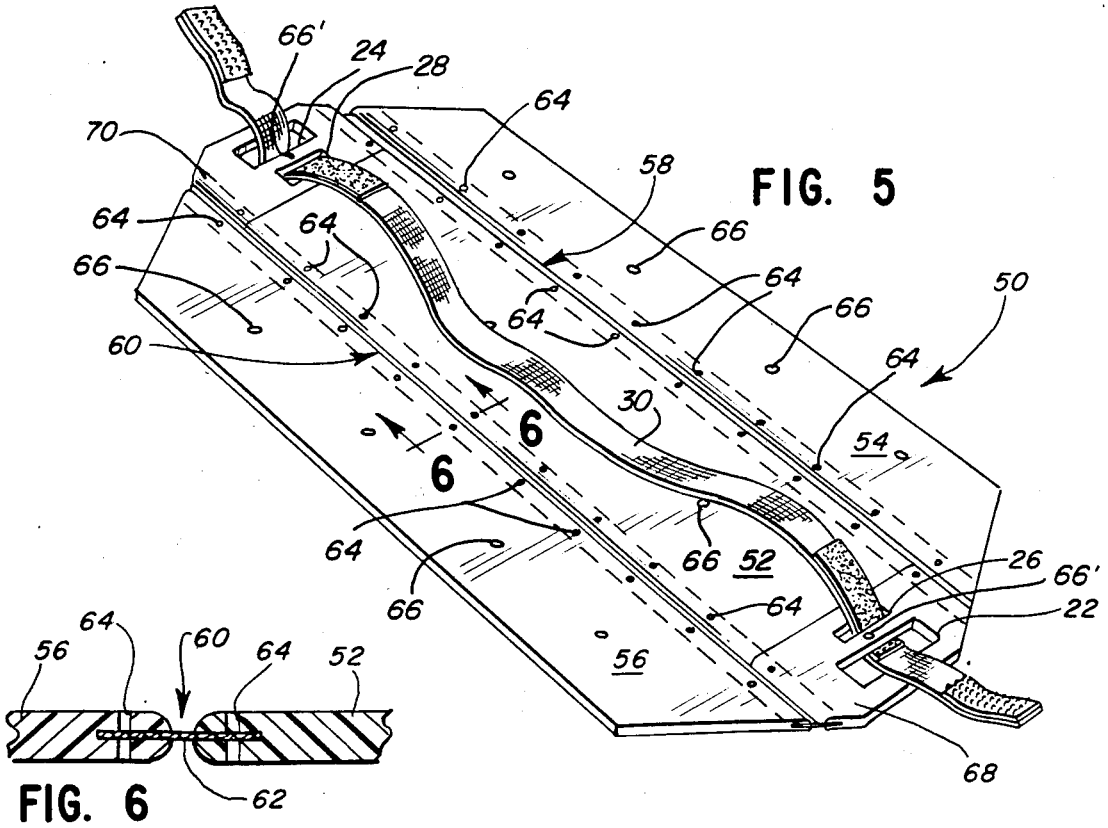
FIG. 5
FIG. 6
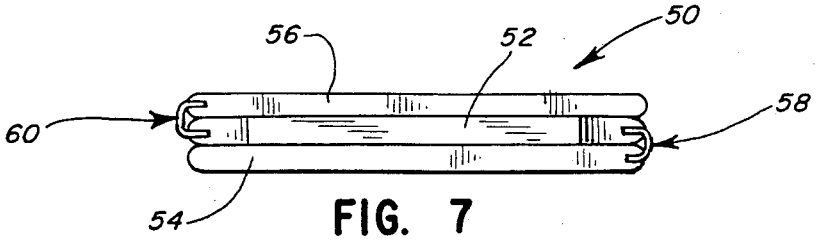
FIG. 7
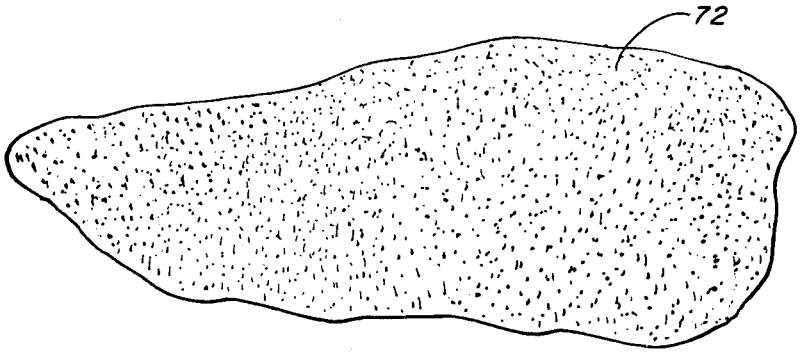
FIG. 8

PATIENT TRANSFER MAT

RELATED APPLICATION

This application is a continuation-in-part of U.S. Ser. No. 830,261 filed Feb. 18, 1986, the disclosure of which is incorporated herein by reference.

BACKGROUND OF THE INVENTION

The invention relates generally to patient moving methods and systems and more particularly to an improved patient transfer mat which is easy to utilize and can be readily folded to store compactly.

Any number of methods and systems have been utilized to shift or more a patient who is unable to move himself. The patient can be partially lifted, slid or rolled onto a stretcher or bed by several attendants. The patient is again moved onto an operating, examining or x-ray table and then the process is repeated to place the patient back into the patient's bed. Each of these moves has the potential to aggravate the patient's injuries or even to cause new injuries.

Numerous types of systems have been utilized to assist in shifting of patients while attempting to minimize risk of injury and to facilitate ease of movement. These systems have included boards and other types of stretcher type units, which have been relatively inflexible or flexible, such as made from sheets, canvas or blankets. One system includes a plastic slab or plank placed longitudinally under the patient. Each of these systems has attempted to provide for ease in placing the patient onto the system. The plastic slab, for example, is about 508 mm by 1016 mm or larger and is made to be longitudinally slid under the patient. The slab is of a size such that the patient is substantially totally supported on the slab and can be moved for lifted on the slab by utilizing hand holds or openings in the edge of the slab. Such a slab is inconvenient to store, because of its size and it does not include any means for securing the patient on the slab.

The improved patient transfer mat provides certain desirable advantages not obtained when the transfer mat invention of Ser. No. 830,261. These advantages derive from an improved flexible hinge means between the panels of the transfer mat. Also, at least one surface of each panel of the mat is striated or textured so that accumulation of static electrical charge on that surface is prevented by reason of friction contact with textile material of a bed sheet or clothing of the patient as the mat is slid under a patient. The improved mat also is structured for convenient and economical injection molding thereof.

SUMMARY OF THE INVENTION

The above and other disadvantages of prior art transfer systems are overcome in acccordance with the present invention by providing an improved elongated transfer mat which is small and easily foldable for storage. The mat is formed from three elongated sections of a substantially rigid material, which sections are molded to include flexible hinges between the sections. The mat can include a strap to secure a patient thereto. The system includes a pair of mats with one placed transversely under the patient's shoulders and another placed transversely under the patient's buttocks. The straps can be secured across the top of the patient and then a single attendant can slide the patient from a bed onto a transfer table or from table to stretcher. Further, the mats have hand holds in their outer ends which can be grasped by the attendant or can be grasped by an attendant on each side to lift the patient.

BRIEF DESCRIPTION OF THE DRAWINGS

FIG. 5 is a perspective view of one improved mat embodiment of the present invention;

FIG. 6 is an enlarged side sectional view of the mat of FIG. 5 taken along the line 6—6 therein;

FIG. 7 is an end view of the folded mat of FIG. 5; and

FIG. 8 is an enlarged view of one surface portion of the mat of FIG. 5.

DESCRIPTION OF THE PREFERRED EMBODIMENTS

FIGS. 1–4 are illustrative of embodiments disclosed in the parent application, U.S. Ser. No. 830,261.

Figure 1:
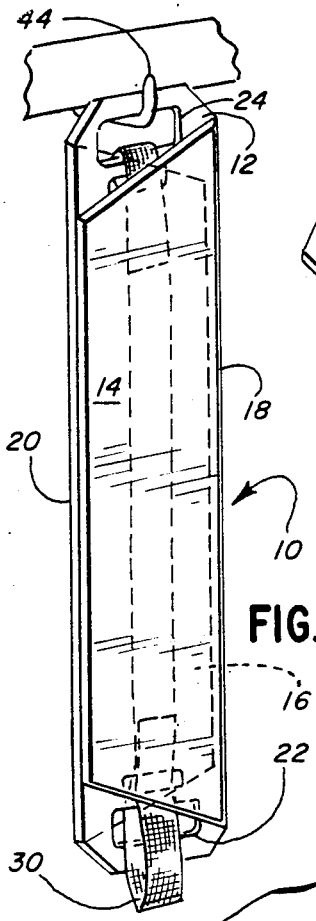
FIG. 1 is a perspective view of a mat of the invention of the parent application folded for storage.
Figure 2:
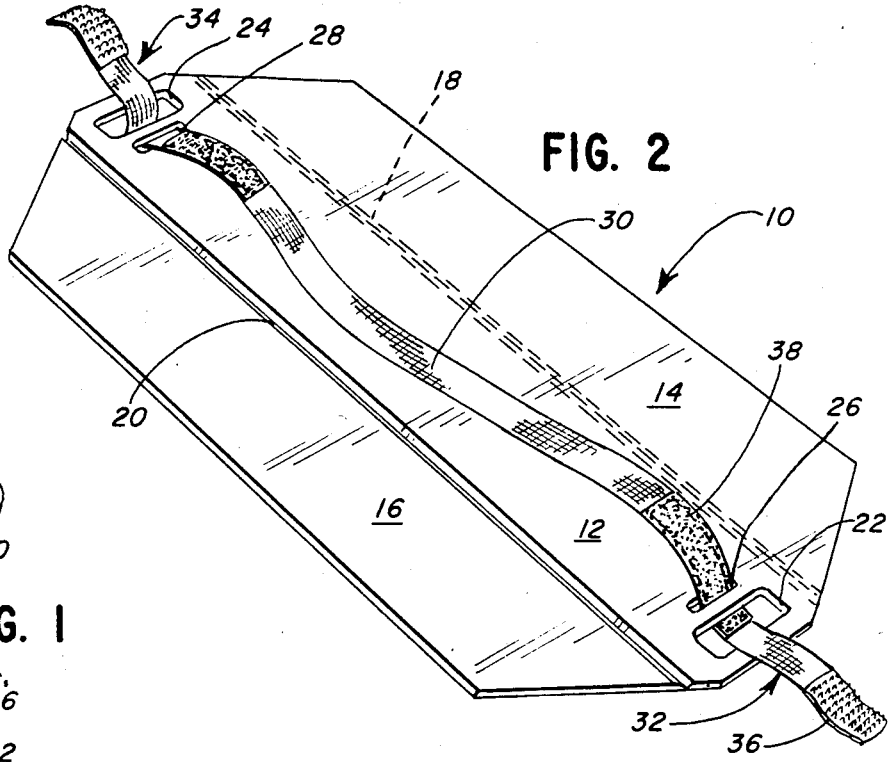
FIG. 2 is a perspective view of the mat of FIG. 1 unfolded for utilization.

Referring to FIGS. 1 and 2, a patient transfer mat embodying the invention of the parent application is designated generally by the reference numeral 10. The mat 10 has an elongated body portion including a center section 12 and a pair of wing sections 14 and 16. The mat 10 preferably is formed in a generally rectangular shape from a plastic material such as polyethylene, with a fairly smooth surface for ease of sliding and positioning of the mats 10 under a patient. The wings 14 and 16 are hingedly connected to the center section 12 along respective hinge regions 18 and 20. The hinge regions 18 and 20 preferably are formed integrally with the wings 14 and 16 and the center section 12, such as by a reduced or thinner thickness of material which allows the wings 14 and 16 to folded over onto the center section 12.

The ends of the mat 10 include respective openings 22, 24 which can be grasped by an attendant to lift or move the patient. A second smaller opening or slot 26, 28 is included adjacent respective openings 22, 24, which slots 26, 28 and openings 22, 24 accomodate a strap 30 therethrough. The strap 30 includes fastening means 32, 34 at each end thereof, such as a typical loop and hook type of fastener which has a loop area 36 and a hook area 38 which adhere to each other when pressed together.

Figure 3:
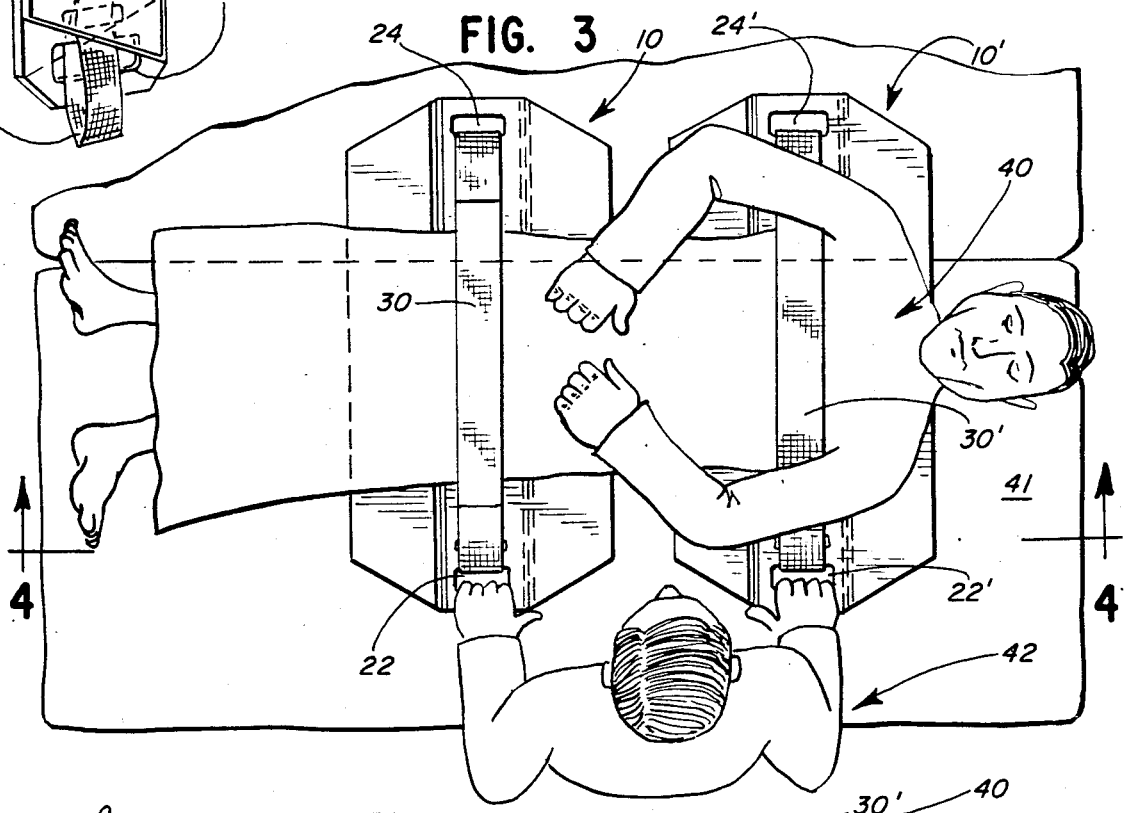
FIG. 3 is a top plan view of a pair of mats of FIG. 1 placed under a patient for movement of the patient.
Figure 4:
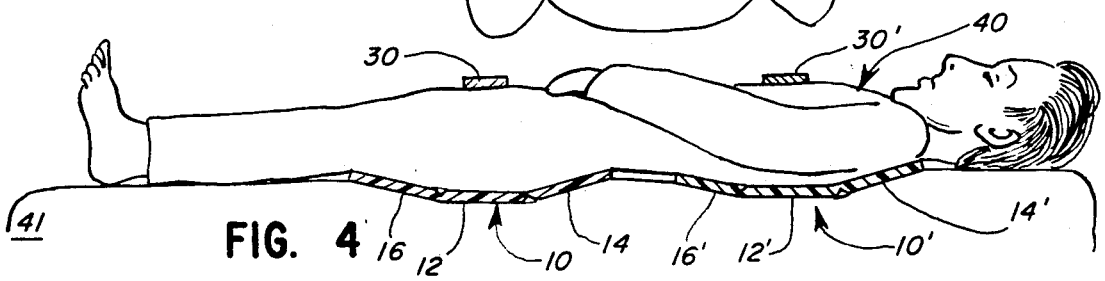
FIG. 4 is a side sectional view of the mats and patient of FIG. 3 taken along the line 4—4 therein.

Referring now to FIGS. 3 and 4, the shifting or moving of a patient 40 onto or out of a bed 41 by an attendant 42 is best illustrated. A pair of mats 10 and 10' is inserted under the patient 40 and then the straps 30, 30' can be fastened over the patient 40 to secure the patient to the mas 10, 10' while the patient is moved. If required, a second attendant (not illustrated) can grasp the pair of mats 10, 10' utilizing the openings 24 and 24', while the attendant 42 grasps the openings 22, 22'. The small/relative surface area of the mats 10, 10' allow them to be easily slid or placed under the patient 40, while still providing the necessary strength to lift the patient 40, if required.

As can be seen in FIG. 4, the mat 10 is placed under the buttocks of the patient 40, while the mat 10' is placed under the upper back of the patient. The respective center and wing sections 12, 14 and 16 and 12', 14' and 16' of the mats 10 and 10' at least partially conform with the contour of the patient's body, when the patient 40 is resting on a surface, such as the bed 41. The folding wing sections 14 and 16 of the mat 10 provide a large and sufficient sliding surface for ease is moving the patient 40, while still allowing the mat 10 to have a small profile for storage. The mats 10, 10' then provide a very easy to use patient moving system, while the mats can be folded for storage, such as on a convenient hook 44 (FIG. 1). The hook 44 or other protuberance can be on a gurney or a transfer bed/stretcher or in any other convenient location.

The improvements of the present invention now will be discussed with reference to FIGS. 5–8.

In FIG. 5, an improved transfer mat embodying the present invention is designated generally by the reference numeral 50. The improvement in the present invention lies primarily in the hinge mechanism allowing the mat sections easily and repeatedly to be folded upon one another. The improved transfer mat 50 illustrated in FIGS. 5–8 is substantially the same in overall function to the mat 10 illustrated in FIGS. 1–4. All common reference numerals refer to the same parts and the mats 50 can replace the mats 10 in the system illustrated in FIGS. 3 and 4.

The mat 50 has an elongated body portion including a center section 52 and a pair of wing sections 54 and 56. The mat 50 preferably is formed in a generally rectangular shape from a suitable plastic material with at least one smooth surface for ease of sliding and positioning of the mats 50 under the patient 40 (FIG. 3). Preferably, a thermosetting type synthetic plastic polymer or resin which provides a rigid, strong and yet somewhat flexible section is desirable. Also, the section should not shatter or fracture under the weight of the patient. Methacrylate polymers and polystyrene are suitable materials.

The wing sections 54 and 56 are hingedly connected to the center section 52 by respective hinge mechanisms 58 and 60. The hinge mechanism 58 and 60 are formed by providing a web of woven polyester or the like material, which is flexible but does not stretch to any appreciable extent in either its longitudinal or lateral extent. As best illustrated in FIG. 6, a web 62 is molded into the edges of the sections 52 and 56. The hinge 58 is formed in a like manner between the sections 52 and 54. Each hinge member is selected to have a thickness of between 0.75–1.25 millimeters, however a thickness of about 1 millimeter is preferred. The width of each web is about 2 centimeters.

The web 62 is first placed in a mold (not illustrated) and then a plurality of holding pins are clamped against the web 62 before the material is injected into the mold to form the sections 52, 54 and 56. The pins hold the web 62 in the proper position and leave a plurality of apertures 64 in the molded sections when the completed mat 50 is removed from the mold.

A plurality of indentations 66 also may be left in the completed sections 52, 54 and 56 from the injection points of the mold. The placement of such injection points and hence the indentations 66 generally is not critical, as long as the points are located to allow sufficient material to adequately fill the mold.

The ends of the mat 50 include respective openings 22, 24 which can be grasped by the attendant 42 to lift or move the patient 40. Second smaller openings or slots 26, 28 are included adjacent the respective openings 22 and 24. The slots 26, 28 and the openings 22, 24 accommodate the straps 30 therethrough for utilization as previously described.

To provide additional strength to the mat 50, each end portion 68 and 70 can be formed of a thicker body of material. It is preferable to include injection points in the narrow area between the openings 22, 26 and 24, 28 as evidenced by the indentations 66'. These injection points ensure that sufficient material is injected into all the areas of the end portions 68 and 70.

The more flexible hinge mechanisms 58 and 60 ensure that the mat 50 easily and repeatedly can be folded for storage as illustrated in FIG. 7. The flexible hinges 58 and 60 also ensure that the folded mat 50 will lie flat for more compact storage. Notably, the individual adjacent sections will not move relative one another because of the manner in which the hinge members are anchored between the engaged sections.

One side of the mat 50 preferably is formed to have a textured surface 72 as illustrated in FIG. 8. The textured surface 72 assists in reducing the friction and static electricity accumulation when the mat 50 is slid under the patient 40. The textured surface 72 can be in the form of small bumps or striations or ridges formed in the mold in a random pattern. Preferably, both surfaces of the sections are so formed.

Modifications and variations of the present invention are possible in light of the above teachings. The strap 30, of course, does not have to be utilized with the mat 50. The strap 30 can be formed from any convenient material and can be eliminated if desired. The exact dimensions of the mat 50 are not critical, but one convenient size is 3 mm thick, 360 mm wide and 600 mm long. The location and number of the clamping apertures 64 and the injection openings is not critical. Each of the hinge webs 62 is illustrated as an integral piece extending the length of said sections, but the web could terminate short of the ends of the mat 50 or even be formed in more than one piece. It is, therefore, to be understood that within the scope of the appended claims the invention can be practiced otherwise than as specifically claimed.

While fabricating the mat, it is contemplated that a lubricant-type ingredient may be mixed with the plastic material fed to the injection molding equipment. Such an ingredient would help facilitate sliding the mat under a body portion of a patient and also, sliding the patient relative to a surface while he is strapped on the mat.

What is claimed and desired to be secured by Letters Patent of the United States is:

1. An improved patient transfer mat comprising:

an elongated body portion having a substantially elongated rectangular shape adapted to be placed transversely under a selected portion of the torso of a patient to facilitate the moving of at least said torso portion of the patient, said body portion having a length substantially less than the length of the patient, but greater than the width of said torso portion and having a width substantially less than said length;

said body portion being formed from a flexible but substantially rigid lightweight material and including means to at least partially conform with the contour of a portion of the patient's body, said means to conform including a center section and a wing section hingedly attached by a hinge mechanism to each side of said center section, which wings pivot at an angle to said center section to provide said conformation and a sufficient sliding surface for moving said patient, said hinge mechanism formed by at least one flexible web molded into the adjacent edges of said sections; and openings in each end of said body portion adapted to be grasped by an attendant to move said patient.

2. The mat as defined in claim 1 wherein each said web is a single integral web piece running substantially the length of said sections.

3. The mat as defined in claim 1 wherein said ends of said body portions including said openings is formed from a thicker portion of material to provide enhanced strength thereto.

4. The mat as defined in claim 1 including a slot spaced inside and adjacent to each said opening and means for securing said patient to said mat adapted to be secured through said slots.

5. The mat as defined in claim 4 wherein said securing means is a strap having means to releaseably secure the ends of the strap to themselves through said slots and openings to secure said patient to said mat.

6. The mat as defined in claim 1 including at least one side of said body portion being formed with a textured surface to reduce friction and static electricity.

7. An improved patient transfer system, said system comprising:

a pair of improved transfer mats, each of said transfer mats including an elongated body portion having a substantially elongated rectangular shape adapted to be placed transversely under a selected portion of the torso of a patient to facilitate the moving of at least said torso portion of the patient, said body portion has a length substantially less than the length of the patient, but greater than the width of said torso portion and having a width substantially less than said length; said body portion being formed from a flexible but substantially rigid lightweight material and including means to at least partially conform with the contour of a portion of the patient's body, said means to conform including a center section and a wing section hingedly attached by a hinge mechanism to each side of said center section which wings pivot at an angle to said center section to provide said conformation and a sufficient sliding surface for moving said patient, said hinge mechanism formed by at least one flexible, said hinge mechanism formed by at least one flexible web molded into the adjacent edges of said section; and openings in each end of said body portion adapted to be grasped by an attendant to move said patient.

8. The system as defined in claim 7 wherein each said web is a single integral web piece running substantially the length of said sections.

9. The system as defined in claim 7 wherein said ends of said body portions including said openings is formed from a thicker portion of material to provide enhanced strength thereto.

10. The system as defined in claim 7 including a slot spaced inside and adjacent to each said opening and means for securing said patient to said mat adapted to be secured through said slots.

11. The system as defined in claim 10 wherein said securing means is a strap having means to releaseably secure the ends of the strap to themselves through said slots and openings to secure said patient to said mat.

12. The system as defined in claim 7 including at least one side of said body portion being formed with a textured surface to reduce friction and static electricity.

13. A method of transferring patients substantially from one contiguous surface to another, comprising;

providing a pair of transfer mats, each of said transfer mats including an elongated body portion including means to at least partially conform with the contour of a portion of the patient's body and having a substantially elongated rectangular shape adapted to be placed transversely under a patient to facilitate the moving of the patient, said body portion having a length substantially less than the length of the patient, but greater than the width of a patient, and a width substantially less than said length, said means to conform including a center section and a wing section hingedly attached to each side of said center section along said length thereof, which wings bend at an angle to said center section to provide said conformation and a sufficient sliding surface for moving the patient, including forming said wings with said center section by molding a flexible web into adjacent edges of said sections;

placing said mats under the patient by sliding one of said mats transversely under the patient's buttocks and slidng the second one of said mats under the patient's shoulders, both without lifting or turning the patient over;

providing openings in each end of said body portion adapted to be grasped by an attendant to move the patient; and transferring said patient by sliding the patient on the two mats from a first one of the contiguous surfaces to the other.

14. The method defined in claim 13 including forming a slot spaced inside and adjacent to each said opening and means for securing said patient to said mat adapted to be secured through said slots and securing the patient to each of said mats prior to moving the patient.

15. The method defined in claim 14 including forming said securing means as a strap having means to releasably secure the ends of the strap to the strap spaced from said end of the strap through said slots and opening to secure the patient to said mat and securing the patient to each of said mats by said straps prior to transferring the patient.

* * * * *